US005307864A

United States Patent [19]

Arvedi et al.

[11] Patent Number: 5,307,864

[45] Date of Patent: May 3, 1994

[54] METHOD AND SYSTEM FOR CONTINUOUSLY PRODUCING FLAT STEEL PRODUCT BY THE CONTINUOUS CASTING METHOD

[75] Inventors: Giovanni Arvedi, Cremona; Giovanni Gosio, Rovato-BS, Italy; Ulrich Siegers, Berlin, Fed. Rep. of Germany; Klaus Brückner, Haan; Peter Meyer, Duisburg; Ernst Windhaus, Duisburg; Fritz-Peter Pleschiutschnigg, Duisburg; Werner Rahmfeld, Mülheim am Ruhr, all of Fed. Rep. of Germany

[73] Assignee: Mannesmann Aktiengesellschaft, Dusseldorf, Fed. Rep. of Germany

[21] Appl. No.: 15,300

[22] Filed: Feb. 8, 1993

Related U.S. Application Data

[63] Continuation of Ser. No. 602,305, Jan. 24, 1991.

[30] Foreign Application Priority Data

May 26, 1988 [IT] Italy ..... 20752 A/88
Nov. 30, 1988 [DE] Fed. Rep. of Germany ..... 3840812

[51] Int. Cl.[5] ..... B22D 11/14; B21B 1/00
[52] U.S. Cl. ..... 164/476; 164/417
[58] Field of Search ..... 164/417, 477, 476; 29/527.7; 148/2

[56] References Cited

U.S. PATENT DOCUMENTS

| | | | |
|---|---|---|---|
| 3,358,358 | 12/1967 | Jenks et al. | 164/476 |
| 4,030,326 | 6/1977 | Morooka et al. | 72/16 |
| 4,617,067 | 10/1986 | Grussier | 164/476 |
| 4,658,882 | 4/1987 | Oba et al. | 164/417 |
| 4,675,974 | 6/1987 | Connolly | 164/476 |
| 4,817,703 | 4/1989 | Rohde et al. | 164/417 |
| 4,846,254 | 7/1989 | Kimura | 164/476 |
| 4,958,677 | 9/1990 | Kimura | 164/476 |
| 4,976,024 | 12/1990 | Kimura | 164/417 |

FOREIGN PATENT DOCUMENTS

| | | | |
|---|---|---|---|
| 174760 | 7/1988 | Japan | 164/417 |
| 2129723 | 5/1984 | United Kingdom . | |

*Primary Examiner*—Paula A. Bradley
*Assistant Examiner*—Erik R. Puknys
*Attorney, Agent, or Firm*—Cohen, Pontani, Lieberman, Pavane

[57] ABSTRACT

A method and system for continuously producing a flat steel product from flat stock produced by the arcuate continuous casting method with a horizontal direction of emergence are disclosed. In one form of the invention, flat stock is shaped after solidification of a strand in a first shaping stage at temperatures exceeding about 1100° C. The stock is then inductively reheated to a temperature of about 1100° C. with approximate temperature equalization of an entire cross-section of the flat stock. The flat stock is additionally shaped in at least one additional shaping stage with rolling speeds in accordance with the stock's accompanying reduction in thickness per pass.

13 Claims, 3 Drawing Sheets

METHOD AND SYSTEM FOR CONTINUOUSLY PRODUCING FLAT STEEL PRODUCT BY THE CONTINUOUS CASTING METHOD

This is a continuation of U.S. application Ser. No. 07/602,305, filed Jan. 24, 1991.

BACKGROUND AND SUMMARY OF THE INVENTION

The present invention relates to a method for continuously producing strip steel or steel sheet from flat stock produced in accordance with the arcuate continuous casting method with a horizontal direction of delivery.

The steel industry faces a great need, either as the result of a general trend or in order to overcome the crisis with which in recent years particularly the operators of out-dated systems have been confronted, to lower operating and investment costs while, at the same time, improving product quality and increasing flexibility with respect to the lots produced, i.e., so-called "coils" or steel sheets. With the modernization of existing steel mills or the planning and creation of new steel mills with the use of new technological concepts and devices, a paramount goal has been to increase productivity and profitability while simultaneously improving product quality and achieving a greater range with regard to the "unit size" in which the final product is to be delivered in order to cover the largest possible range of uses.

One of the new technologies that is currently being promoted in view of the current demands on steel production involves the processing steps between a melting of steel and either (i) the winding up of strip steel in the form of "coils" or (ii) the stacking of sheets. The new technology comprises the casting of thin slabs in a thickness close to their final dimensions, which can then be processed further into the desired final product in only a few subsequent passes or deformation steps. This has led to remarkable improvements in continuous casting technology, particularly with respect to mold construction and of the corresponding immersed outlet, and also to improvements in the construction of roll stands and trains with the goal of achieving the desired deformation in the fewest possible number of passes.

Plants for the production of strip steel have become known, even though described as "pilot plants", in which thin slabs of a thickness of about 50 mm are produced by the continuous casting method, as compared with conventional slabs having a thickness range of 150 to 320 mm. These thin slabs pass through the successive rolling/processing steps in different ways; the final product is strip steel of a thickness of only a few millimeters. It has been previously proposed to roll out the cast product, immediately after an intermediate heating in a furnace, for instance in a tandem train having six stands. Since the casting speed cannot be much faster than about 5 meters per minute, the rolling speeds which thus results on the last stand of the rolling train are too slow to maintain the required final rolling temperatures of at least about 865° C. That is to say, the strip undergoes excessive cooling between one rolling step and the next step due to its low speed, which is identical to the casting speed, upon entering the rolling train. This solution was, therefore, abandoned since it was not possible to solve the problem economically even with heat protection devices and heated rolls because this would have resulted in a considerable increase in investment and operating expenses.

Another approach proposes cutting the strip in front of a heating furnace in which the heat treatment (temperature equalization) of the strip over its entire cross-section subsequently takes place. It can, for instance, be a gas-heated roller furnace with which, independent of the casting speed which is to be taken into account, a temperature of the strip at the outlet of the furnace of about 1100° C. can be set, i.e. a temperature which is optimal for the subsequent rolling process. The strip is cut to a standard length, which for a certain weight of the coil can, for instance, be about 50 meters, which requires a corresponding furnace length of about 150 meters if the required buffer action is taken into account.

By uncoupling the rolling train from the casting process proper, the rolling out of the thin slab or "rough strip" can be carried out at higher speeds, so that a drop in temperature to below the minimum temperature permissible for the final rolling stage need not be feared. In this connection, the length of the furnace—which amounts to about three times the length of the length of strip—results, aside from a considerable increase in equipment investment, also in enormous space requirements which cannot be satisfied by many steel mills.

In addition, the dimensions of the plant and thus of the furnace impose limits on the length of the successive lengths of strip to be treated and thus also on the final weight of the coil. The coil's final weight, in turn, limits the range of use for production of coils of very large diameter. Accordingly, a plant of this type also does not afford the possibility of using even thinner initial slabs should this become possible as a result of the further technological development of the continuous casting method. Assuming an initial thickness of 25 mm—as has already been done hypothetically—instead of 50 mm, the strip would have to be divided into lengths of about 100 meters in order to obtain the same final weight of the coil, which would require a length on the order of magnitude of about 300 meters for the treatment furnace, which is not feasible both from a practical and from an economic standpoint.

It is, therefore, an object of the present invention to create a method of the type described above and a corresponding plant to carry out this method by means of which a steel strip can be continuously produced from a flat product coming from an arcuate continuous casting plant without incurring the above-mentioned disadvantages.

In particular, cutting of the strand between the casting and at least the first rolling is dispensed with, the casting strand passing in the first roll stand at the speed at which the rolled stock leaves the arcuate section of the continuous casting plant. Thus, the method is to be carried out "in line" with practically unlimited flexibility so that it becomes possible to produce coils of any desired weight and length or sheets without changing the dimension parameters of the plant since the cutting of the rolled strip is conducted at least after the first rolling or after conducting all operating steps directly in front of the reeling or stacking device.

The foregoing object is achieved by a method which is characterized by the following steps:

a) Shaping flat stock after complete solidification of the strand in a first shaping step at temperatures of more than 1100° C.;

b) Inductive reheating of the flat stock to a temperature of about 100° C. with approximate temperature equalization over the entire cross-section of the flat stock; and c) Shaping of the flat stock in at least one additional shaping step at rolling speeds corresponding to the specific reduction per pass.

In a further embodiment of the method, the strip between the first and the next deformation step is wound up. The rolled-out strip can be wound up according to the desired weight of coil following the forming of the flat product, or it can be stacked after cutting the rolled-out strip following the forming of the flat product in predetermined lengths so as to form stacks of steel sheet, possibly after cooling and straightening. The flat product is therefore first of all passed through a first roll stand at the speed of emergence of the product from the arcuate continuous casting plant and passes through the successive rolling stages always at speeds which correspond to the deformations in the individual passes. The strip which has been rolled in this manner is then either wound up and cut when the desired weight of coil is reached or the strip is subdivided into desired lengths and stacked as sheets. An important aspect of the present invention is the inductive reheating of the flat product, after descaling, to temperatures of about 1100° C. preferably with the best possible temperature equalization since, in this way, excessive cooling of the strip can be favorably counteracted.

A further embodiment of the invention includes one or more steps of inductive intermediate heating of the flat product between the above-mentioned shaping steps. By this intermediate heating, excessive cooling of the rolling stock is also counteracted, so that the required roll temperatures can always be set in the manner that the temperatures in the last shaping step do not drop below a limit value of 860° C.

Another embodiment of the invention provides the following additional steps:

Adjustment of the shaping steps after passage of a starting bar which is provided upon the casting process;

Separation of the starting bar directly prior to winding up the strip or prior to stacking of the sheets; and Differentiated heat control in successive steps/zones after passage of the initial bar.

After passage through the roll stands, the starting bar can be cut off by the device which is in any event present for the subdividing of the rolled strips, or it can be cut off by an additional cutting device arranged behind the first forming step.

The plant for carrying out the method of the invention is characterized by the following plant parts in the sequence indicated:

a) A mold for the continuous casting of flat products with a subsequent guide stand in arcuate shape;

b) A first shaping unit for forming the flat product in the guide stand and/or immediately behind it;

c) A device for inductive heating and for approximate temperature equalization over the cross-section of the flat product;

d) At least one additional roll stand; and e) A cutting device.

The cutting device can be arranged subsequent to the first shaping unit and between the first shaping unit and the additional shaping unit. A unit can be provided for winding up and unwinding the flat product, the cutting device being arranged in front thereof. The unit for winding up and unwinding the flat product is preferably arranged behind the device for inductive heating and in front of the additional shaping unit.

As an alternative, this system is followed, in accordance with the invention, either by a cutting device for the rolled strip and at least one reel for winding up the strip or by a cutting device for the rolled strip, a cooling device, a straightening machine, and a stacking device for the separated sheets.

In a further embodiment of the invention, the system includes, in addition, at least one inductive heating device in order to effect an intermediate heating between the additional roll stands.

Each of these devices is advantageously provided with heating stages that can be individually controlled.

In accordance with an embodiment of the invention, the system is furthermore equipped with devices for adjusting the cross-section of passage between the rollers of the first shaping unit and the additional roll stands in order to permit the passage of the starting bar present at the head of the casting strand and to reduce the cross-sections back to the customary passage values immediately after passage of the starting strand. Devices are provided for successive control of the individual heating stages of the furnaces immediately after passage of the starting bar. The cutting device for cutting off the starting bar is also used for cutting the rolled strip, i.e. as the cutting device present in the final section of the plant.

In accordance with another proposal of the invention, the cutting device that is arranged behind the first shaping unit is used for cutting off the starting bar.

BRIEF DESCRIPTION OF THE DRAWING

The invention will be explained below with reference to one embodiment which is shown in the drawing, in which.

DETAILED DESCRIPTION OF THE PREFERRED EMBODIMENTS

Figure 1:
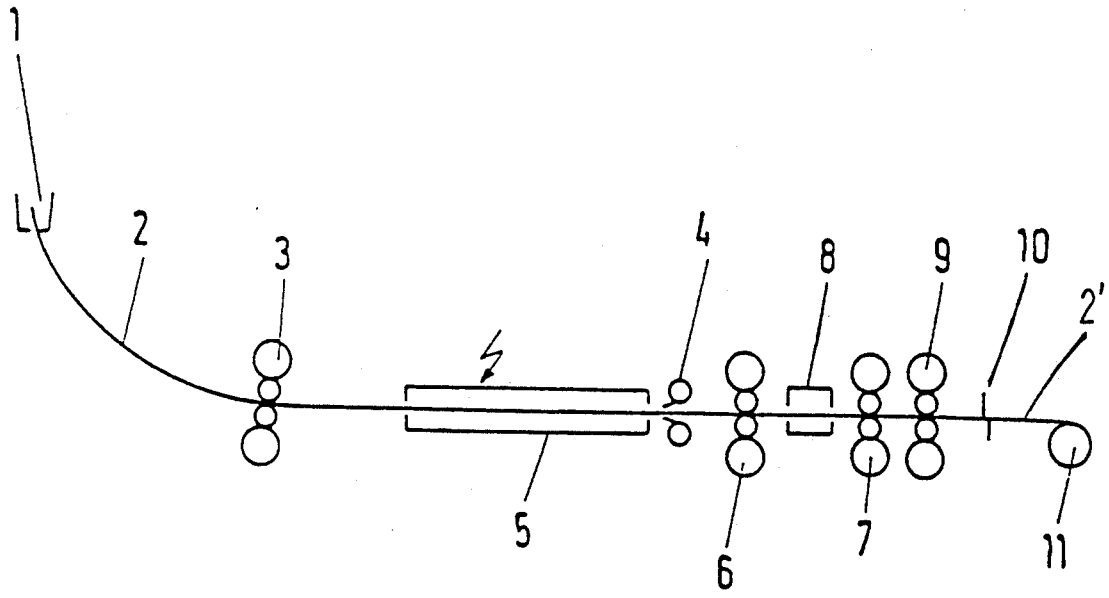
FIG. 1 is a diagrammatic partial view of the system of the invention.

The drawing shows diagrammatically a plant of the invention on the basis of which the corresponding method will be described. Proceeding from a continuous casting mold which bears the reference number 1 in the drawing, the flat product 2 is produced. The flat product 2, which is guided and transported in conventional support rollers, passes from the initial vertical direction via arcuate section, formed by support rolls, into the horizontal direction. After complete solidification, i.e. in the final region of the arcuate section, the flat product travels, according to the invention, through a first shaping stage 3 in which it is brought, for instance, to a maximum thickness of 25 mm. The shaping stage 3 may consist of one or several roll units, preferably in 4-high arrangement.

For temperature equalization, a furnace 5 is then present, which is preferably equipped with an inductive heating device. In the furnace 5, an approximate, and preferably a maximum, temperature equalization over the entire cross section of the flat product 2 takes place simultaneously so that the product reaches the first stand 6 of the additional shaping unit with a sufficient rolling temperature.

Should an excessively slow initial pass speed corresponding to the speed upon the emergence from the arcuate section lead to a considerable drop in temperature so that an insufficient shaping temperature results in the second roll stand 7 of the additional shaping device, then an additional intermediate heating may be provided between roll stands 6 and 7 in the form of a second induction furnace 8, which may be shorter than the furnace 5. This second induction furnace, however, is only required if furnace 5 is not sufficient in order to establish the corresponding temperature gradient along the entire additional shaping unit which consists of the three roll stands 6, 7 and 9, in such a manner that, upon the pass into the last roll stand 9, the temperature is within an order of magnitude that is sufficient for good deformation. Upon emergence from the last roll stand 9, a flat product 2, which is now designated as strip 2', has the desired thickness.

Figure 2:
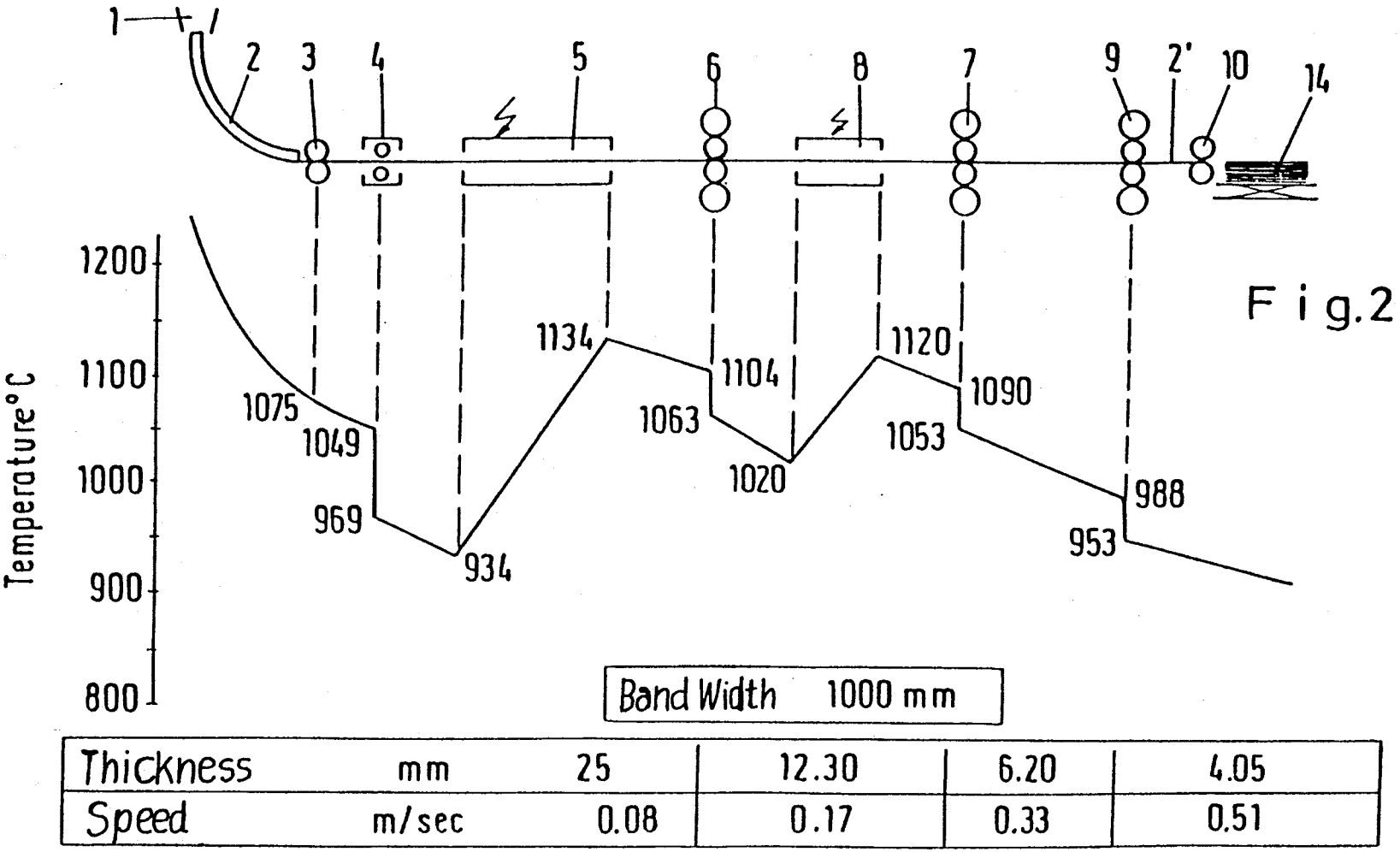
FIG. 2 shows the variation in temperature of a steel strip being formed.

The process is concluded either with the winding of the rolled strip 2' on the reel 11 and the cutting at 10 when the desired coil weight is reached, or with the cutting of the strip 2' into desired lengths and their subsequent stacking on a stacking device 14 which is shown diagrammatically in FIG. 2.

Without the necessity of additional cutting devices, the device for cutting the strip 10 at the start of the operating cycle can also be used for cutting the starting bar (not shown), which is cut off after passing through the disconnected induction furnace 5 and the opened rolls of the shaping unit 6, 7 and 9—and through the possibly provided and also disconnected intermediate heating unit 8. Corresponding adjusting devices 9 (not shown) are provided by means of which, immediately after the passage of the starting bar, the rolls can be adjusted again to the normal roll nip required for shaping. Furthermore, the heating devices 5 preferably are formed of zones which are independent of each other so that, proceeding from the disconnected state of the furnace, the zones of the furnace passed through in each case by the starting bar can be connected one after the other for heating.

On the basis of the diagrammatic showing of the individual sections for a plant in accordance with FIG. 1, FIG. 2 shows (using the same designations) the variation in temperature of the flat product 2 up to the emergence of the strip 2' from the last roll stand. Below the graph there is shown a table from which, in correspondence with given sections of the plant and corresponding sections of the strip, the specific speed with corresponding thickness can be noted. The values recorded were obtained experimentally with a strip of a width of 1,000 mm and a thickness of 25 mm. Of course, with other dimensions and speeds a different temperature curve will be obtained.

It can be noted from the figure that the flat product 2 resulting from the casting-rolling process has a temperature of 1,075° C. upon emergence from the first shaping stage 3, which temperature drops to 1,049° C. on the way to the descaling device 4. Due to the water descaling provided in this arrangement, the temperature drops abruptly to 969° C. and cools down further to 934° C. up to the furnace 5.

In the furnace or inductive heating device 5, the temperature rises again to 1,134° C., with approximate temperature equalization taking place over the entire cross-section of the flat product. Before reaching roll stand 6, the flat product experiences a drop in temperature to 1,104° C., the temperature only amounting to 1,063° C. upon emergence from the roll stand due to contact with rolls of the roll stand. In the case described, the partially rolled strip is heated from 1,020 to 1,120° C. in an interposed inductive furnace 8. Upon passing into the second roll stand 7, the temperature is 1,090° C. and again drops, to 1,053° C., upon leaving said roll stand, it dropping to 988° C. upon entering the third and last roll stand 9. This temperature is sufficient as a pass temperature for the last rolling process; the rolled stock 2' leaves the last roll stand 9 with a temperature of 953° C. and is then cut into the desired lengths at a still lower temperature and stacked or wound up as shown in FIG. 1.

As far as variation in speed is concerned, in the case of the disclosed embodiment it is 0.08 meters/second or 4.8 meters/minute upon leaving the first shaping step 3. This corresponds to the pass speed upon entrance into the roll stand of the additional shaping unit where the thickness of the flat product is still 25 mm. The pass speed upon entering the roll stand 7 is 10.2 m/min. (0.17 m/sec.) with simultaneous forming of the flat product from 25 mm to 12.3 mm. The rolled stock enters the last roll stand With a speed of 19.8 m/min. (0.33 m/sec.) and a thickness of 6.2 mm and leaves the roll stand with a final thickness of 4.05 mm and a speed of 30.6 m/min. (0.51 m/sec.).

As is evident from the above embodiment, which can, in principle, be applied to other strip cross-sections, the heating that precedes the first roll stand of the additional shaping unit and any possible intermediate heating which takes place between the first and additional roll stands must be adjusted in such a manner that heating of the flat product or rolled strip to a temperature of about 1,100° C. takes place after the first pass and that the temperature level is maintained in such a manner that the final rolling temperature in the last roll stand does not drop below the limit value of 860° C.

Figure 3:
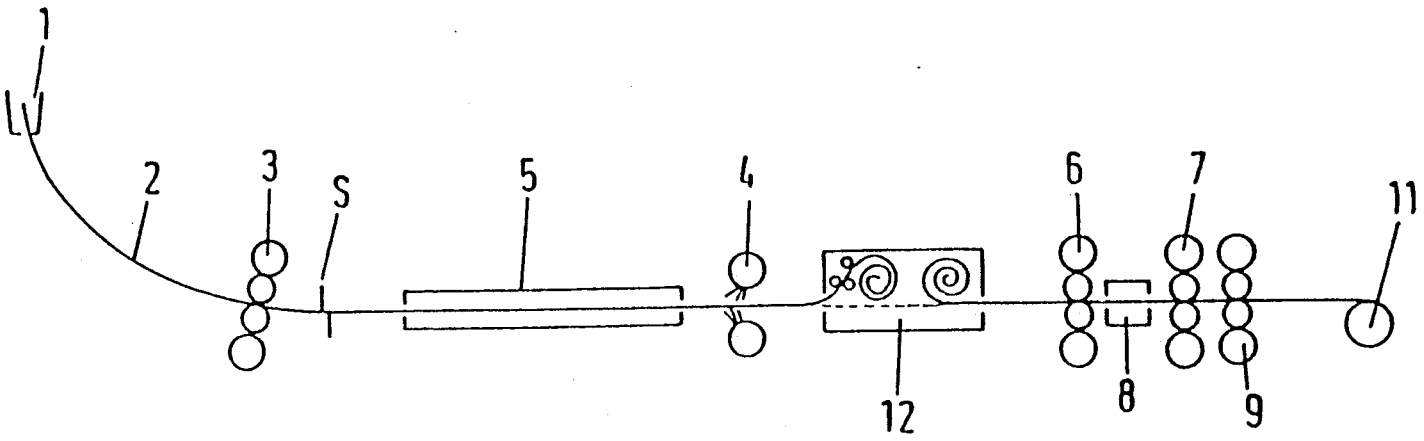
FIG. 3 shows a modified embodiment of the invention.

In the modified embodiment shown in FIG. 3, a winding and unwinding device 12 is used. As shown in the drawing, the winding and unwinding device is in this case installed subsequent to induction furnace 5. The arrangement is supplemented by a descaling device 4. The winding and unwinding reel 12 is wound with flat material until reaching the desired coil size. After the wound coil has been brought into the unwinding position (on the right-hand side of the drawing), the flat material is fed for further processing to the additional shaping unit 6, 7 and 9 consisting of one or more shaping stands. If required, an additional induction furnace 8 can be installed between the roll stands of the additional forming unit. The final coil is produced at 11, for instance on a down-coiler.

Of course, all parameters of the plant can be affected by corresponding adjustment of casting speed, rolling speeds and deformations.

The above description of the invention discloses a method, as well as a plant, or system, for the carrying out the method, which permits continuous casting and final rolling of a starting product with low investment costs and energy expense. It has been found that the heating output required for the inductive heating in a specific embodiment does not exceed the limits of about 8 MW, which can definitely be considered economical for a steel mill of corresponding size.

The method of the invention, which has been described and illustrated and the plant, or system, required for carrying out the method, can be varied within the objectives of the invention and, in particular, the heating device provided in front of the rolling train or between the roll stands can be replaced by furnaces other than the above-mentioned induction furnaces; for instance, furnaces operating with laser technology or radiation furnaces could be used. It should be understood that the preferred embodiments and examples described are for illustrative purposes only and are not to be construed as limiting the scope of the present invention which is properly delineated only in the appended claims.

What is claimed is:

1. A method of continuously producing a flat steel product from flat stock produced by an arcuate continuous casting method, said flat stock having a starting bar and a horizontal direction of emergence, said method comprising the steps of:

(a) first shaping the flat stock by reducing its thickness after solidification in a first shaping stage at temperatures exceeding about 1100° C. to produce unwound shaped flat stock;

(b) then inductively reheating the unwound flat stock without winding to a temperature of about 1100° C. with approximate temperature equalization of the entire cross-section of the flat stock;

(c) winding the inductively reheated flat stock after said inductive reheating; and (d) unwinding and shaping the flat stock in at least one additional shaping stage, said additional shaping stage operating at a rolling speed which is depended upon a reduction in thickness of the flat stock.

2. The method according to claim 1, further comprising the step of winding the stock after said shaping step (c), and then cutting said stock according to a desired weight of coil product.

3. The method according to claim 1, further comprising the step of winding the stock after said shaping step (c), into predetermined lengths and stacking said lengths to form stacks.

4. The method according to claim 1, wherein said step (c) of shaping comprising shaping with at least two successive shaping stages, and wherein the method further comprises one or more steps of inductive intermediate heating of the flat stock between successive shaping stages.

5. The method according to claim 1, further comprising the steps of:

adjusting the shaping steps (a) and (c) after passage of the starting bar;

cutting off the starting bar immediately prior to winding or cutting the flat steel product; and selectively controlling the reheating in successive shaping steps after passage of the starting bar.

6. The method according to claim 1, wherein the step of inductively reheating the stock comprises inductively heating the stock in a plurality of successive zones after passage of the starting bar.

7. A system for continuously producing a flat steel product from flat stock produced by an arcuate continuous casting method, said flat stock having a starting bar and a horizontal direction of emergence, said system comprising:

(a) a mold for continuously casting flat steel stock;

(b) an arcuate guide stand for guiding and transporting said flat steel stock from said mold and for permitting the flat stock to solidify;

(c) a first roll stand disposed in or immediately after the guide stand for shaping the solidified flat stock by reducing its thickness for producing unwound shaped flat stock;

(d) a heating device for inductively heating said unwound shaped flat stock without winding and for achieving approximate temperature equalization over the cross section of the unwound flat stock after the flat stock leaves said first shaping unit;

(e) a device for winding and unwinding the flat stock disposed downstream of said heating device;

(f) at least one additional roll stand subsequent to said winding and unwinding device; and (g) a cutting device positioned after said first shaping unit.

8. The system according to claim 7, wherein the cutting device includes means for cutting the starting bar from the flat stock.

9. The system according to claim 7, further comprising a cutting device for the flat steel product subsequent to said at least one additional roll stand, and at least one reel for winding up the stock.

10. The system according to claim 7, further comprising, subsequent to said at least one additional roll stand, a cutting device for the flat stock and a stacking device for flat steel product.

11. The system according to claim 7, wherein said at least one additional roll stand comprises at least two successive roll stands, and wherein the system includes an inductive heating device intermediate successive roll stands.

12. The system according to claim 11, wherein each of said heating devices includes a plurality of separately controllable and successive heating stages.

13. The system according to claim 9, further comprising:

means for adjusting the cross-section of passage between respective rolls of the shaping unit and of the additional roll stands to permit the passage of a starting bar from the flat stock, and for adjusting the passage cross-sections, after passage of the starting bar, to that required for shaping steps of stock subsequently produced by the casting method; and means for controlling the heating device by activating the heating device immediately after passage of the starting bar; and means included in the cutting device for cutting off said starting bar.

* * * * *